US006585045B2

(12) United States Patent
Lee et al.

(10) Patent No.: US 6,585,045 B2
(45) Date of Patent: Jul. 1, 2003

(54) FORMATION TESTING WHILE DRILLING APPARATUS WITH AXIALLY AND SPIRALLY MOUNTED PORTS

(75) Inventors: Jaedong Lee, Houston, TX (US); John M. Michaels, Houston, TX (US); Volker Krueger, Celle (DE); Matthias Meister, Celle (DE); Per-Erik Berger, Vestre Amoy (NO)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/930,618

(22) Filed: Aug. 15, 2001

(65) Prior Publication Data

US 2002/0046835 A1 Apr. 25, 2002

Related U.S. Application Data

(60) Provisional application No. 60/225,496, filed on Aug. 15, 2000.

(51) Int. Cl.[7] ..... E21B 47/00; E21B 49/10

(52) U.S. Cl. ..... 166/252.5; 166/250.02; 166/250.17; 166/250.01; 166/100; 175/50

(58) Field of Search ..... 166/252.5, 250.02, 166/250.17, 100; 175/50

(56) References Cited

U.S. PATENT DOCUMENTS 2,747,401 A 5/1956 Doll ..... 73/151
4,742,459 A * 5/1988 Lasseter ..... 166/100
4,936,139 A 6/1990 Zimmerman et al. ..... 73/155
5,279,153 A 1/1994 Dussan V et al. ..... 73/155
5,549,159 A 8/1996 Shwe et al. ..... 166/250.02
5,934,374 A * 8/1999 Hrametz et al. ..... 166/100
6,026,915 A * 2/2000 Smith et al. ..... 166/100

FOREIGN PATENT DOCUMENTS

EP 0950795 A2 10/1999
EP 0950795 A3 8/2001

* cited by examiner

*Primary Examiner*—David Bagnell
*Assistant Examiner*—Robert D Jones
(74) *Attorney, Agent, or Firm*—Madan, Mossman & Sriram, P.C.

(57) ABSTRACT

An apparatus and method for determining permeability of a subterranean formation is provided. The apparatus and method comprise a work string, at least one selectively extendable member mounted on the work string to isolate a portion of the annular space between the work string and borehole. A predetermined distance proportional to the radius of a control port separates at least two ports in the work string. A sensor operatively associated with each port is mounted in the work string for measuring at least one characteristic such as pressure of the fluid in the isolated section.

17 Claims, 12 Drawing Sheets

FORMATION TESTING WHILE DRILLING APPARATUS WITH AXIALLY AND SPIRALLY MOUNTED PORTS

RELATED APPLICATION

This application is related to a U.S. provisional application titled "Formation Testing While Drilling Apparatus with Axially and Spirally Mounted Ports" filed on Aug. 15, 2000, Ser. No. 60/225,496, and from which priority is claimed for the present application.

BACKGROUND OF THE INVENTION

1. Field of the Invention

This invention relates to the testing of underground formations or reservoirs and more particularly relates to determining formation pressure and formation permeability.

2. Description of the Related Art

To obtain hydrocarbons such as oil and gas from a subterranean formation, well boreholes are drilled into the formation by rotating a drill bit attached at a drill string end. The borehole extends into the formation to traverse one or more reservoirs containing the hydrocarbons typically termed formation fluid.

Commercial development of hydrocarbon fields requires significant amounts of capital. Before field development begins, operators desire to have as much data as possible in order to evaluate the reservoir for commercial viability. Various tests are performed on the formation and fluid, and the tests may be performed in situ. Surface tests may also be performed on formation and fluid samples retrieved from the well.

One type of formation test involves producing fluid from the reservoir, collecting samples, shutting-in the well and allowing the pressure to build-up to a static level. This sequence may be repeated several times at several different reservoirs within a given borehole. This type of test is known as a Pressure Build-up Test or drawdown test. One of the important aspects of the data collected during such a test is the pressure build-up information gathered after drawing the pressure down, hence the name drawdown test. From this data, information can be derived as to permeability, and size of the reservoir.

The permeability of an earth formation containing valuable resources such as liquid or gaseous hydrocarbons is a parameter of major significance to their economic production. These resources can be located by borehole logging to measure such parameters as the resistivity and porosity of the formation in the vicinity of a borehole traversing the formation. Such measurements enable porous zones to be identified and their water saturation (percentage of pore space occupied by water) to be estimated. A value of water saturation significantly less than one is taken as being indicative of the presence of hydrocarbons, and may also be used to estimate their quantity. However, this information alone is not necessarily adequate for a decision on whether the hydrocarbons are economically producible. The pore spaces containing the hydrocarbons may be isolated or only slightly interconnected, in which case the hydrocarbons will be unable to flow through the formation to the borehole. The ease with which fluids can flow through the formation, the permeability, should preferably exceed some threshold value to assure the economic feasibility of turning the borehole into a producing well. This threshold value may vary depending on such characteristics as the viscosity of the fluid. For example, a highly viscous oil will not flow easily in low permeability conditions and if water injection is to be used to promote production there may be a risk of premature water breakthrough at the producing well.

The permeability of a formation is not necessarily isotropic. In particular, the permeability of sedimentary rock in a generally horizontal direction (parallel to bedding planes of the rock) may be different from, and typically greater than, the value for flow in a generally vertical direction. This frequently arises from alternating horizontal layers consisting of large and small size formation particles such as different sized sand grains or clay. Where the permeability is strongly anisotropic, determining the existence and degree of the anisotropy is important to economic production of hydrocarbons.

A typical tool for measuring permeability includes a sealing element that is urged against the wall of a borehole to seal a portion of the wall or a section of annulus from the rest of the borehole annulus. In some tools a single port is exposed to the sealed wall or annulus and a drawdown test as described above is conducted. The tool is then moved to seal and test another location along the borehole path through the formation. In other tools, multiple ports exist on a single tool. The several ports are simultaneously used to test multiple points on the borehole wall or within one or more sealed annular sections.

The relationship between the formation pressure and the response to a pressure disturbance such as a drawdown test is difficult to measure. Consequently, a drawback of tools such as those described above is the inability to accurately measure the effect on formation pressure caused by the drawdown test.

In the case of the single port tool, the time required to reposition the port takes longer than time is required for the formation to stabilize. Therefore, the test at one point has almost no effect on a test at another point making correlation of data between the two points of little value. Also, the distance between the test points is now known to be critical in accurate measurement of the permeability. When a tool is moved to reposition the port, it is difficult to manage the distance between test points with the precision required for a valid measurement.

A multiple port tool is better than a single port tool in that the multiple ports help reduce the time required to test between two or more points. The continuing drawback of the above described multiple port tools is that the distance between ports is too large for accurate measurement.

SUMMARY OF THE INVENTION

The present invention addresses the drawbacks described above by providing an apparatus and method capable of engaging a borehole traversing a fluid-bearing formation to measure parameters of the formation and fluids contained therein.

An apparatus for determining a parameter of interest such as permeability of a subterranean formation is provided. The apparatus comprises a work string for conveying a tool into a well borehole, at least one selectively extendable member mounted on the work string. When extended, the at least one extendable member is in sealing engagement with the wall of the borehole and isolates a portion of the annular space between the work string and borehole. At least two ports in the work string are exposable to formation fluid in the isolated annular space. The distance between the ports is proportional to the radius of a control port to provide effective response measurement. A sensor operatively associated with each port is mounted in the work string for measuring at least one characteristic such as pressure of the fluid in the isolated section.

In addition to the apparatus provided, a method is provided for determining a parameter of interest of a subterranean formation in situ by conveying a work string into a well borehole. The work string and borehole have an annular space extending between the borehole and a wall of the borehole. At least one selectively extendable member is disposed on the work string for isolating a portion of the annulus. At least two ports are exposed to a fluid in the isolated annulus, and the at least two ports are separated from each other by a predetermined distance proportional to the size of at least one of the ports. A measuring device is used to determine at least one characteristic of the fluid in the isolated section indicative of the parameter of interest.

The novel features of this invention, as well as the invention itself, will be best understood from the attached drawings, taken along with the following description, in which similar reference characters refer to similar parts, and in which:

DESCRIPTION OF PREFERRED EMBODIMENTS

Figure 1:
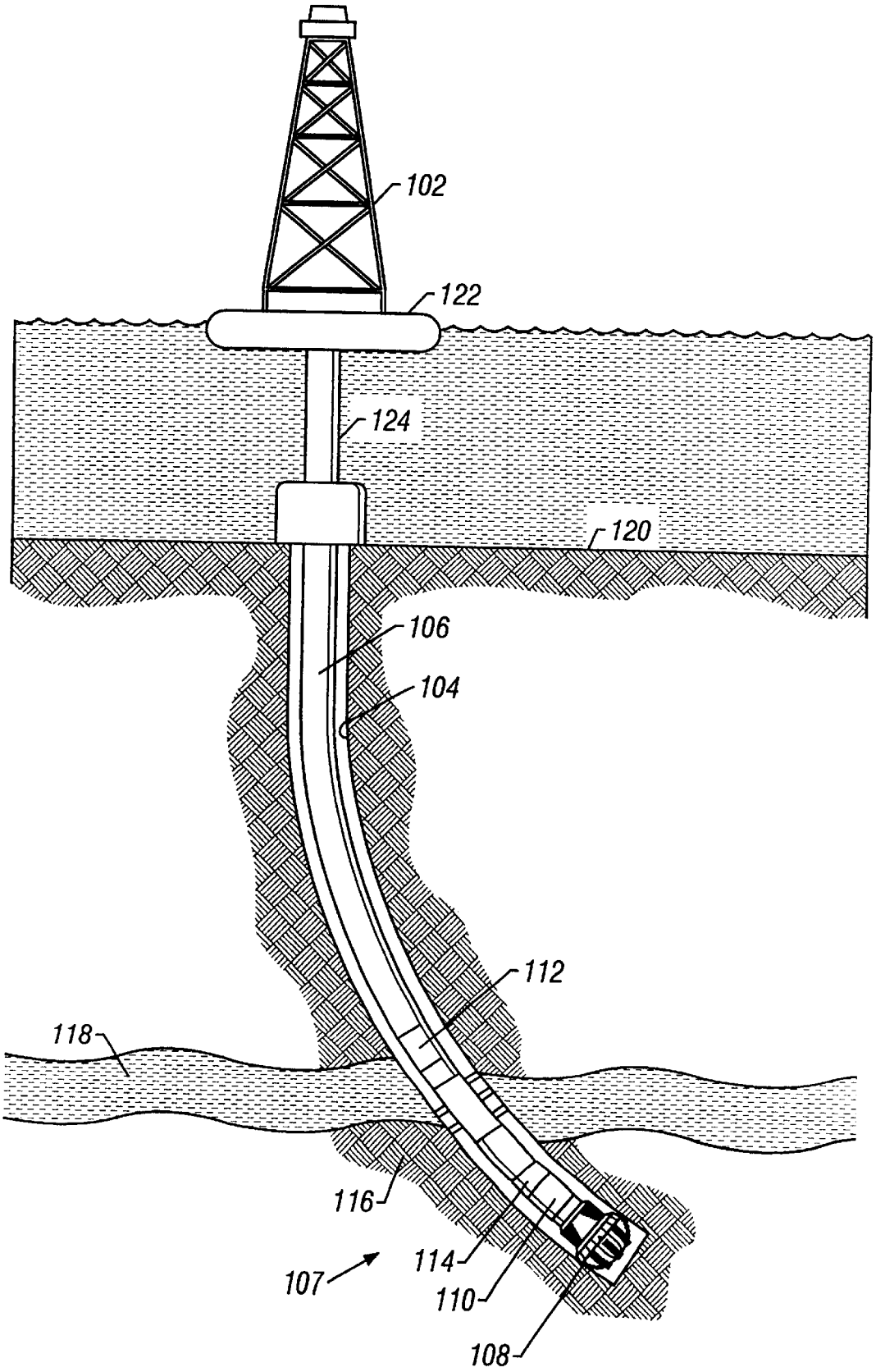
FIG. 1 is an elevation view of an offshore drilling system according to one embodiment of the present invention.

FIG. 1 is a typical drilling rig 102 with a well borehole 104 being drilled into subterranean formations 118, as is well understood by those of ordinary skill in the art. The drilling rig 102 has a work string 106, which in the embodiment shown is a drill string. The drill string 106 has a bottom hole assembly (BHA) 107, and attached thereto is a drill bit 108 for drilling the borehole 104. The present invention is also useful in other drill strings, and it is useful with jointed pipe as well as coiled tubing or other small diameter drill string such as snubbing pipe. The drilling rig 102 is shown positioned on a drilling ship 122 with a riser 124 extending from the drilling ship 122 to the sea floor 120. The present invention may also be adapted for use with land-based drilling rigs.

If applicable, the drill string 106 can have a downhole drill motor 110 for rotating the drill bit 108. Incorporated in the drill string 106 above the drill bit 108 is a typical testing unit, which can have at least one sensor 114 to sense downhole characteristics of the borehole, the bit, and the reservoir. Typical sensors sense characteristics such as temperature, pressure, bit speed, depth, gravity, orientation, azimuth, fluid density, dielectric etc. The BHA 107 also contains the formation test apparatus 116 of the present invention, which will be described in greater detail hereinafter. A telemetry system 112 is located in a suitable location on the drill string 106 such as above the test apparatus 116. The telemetry system 112 is used for command and data communication between the surface and the test apparatus 116.

Figure 2:
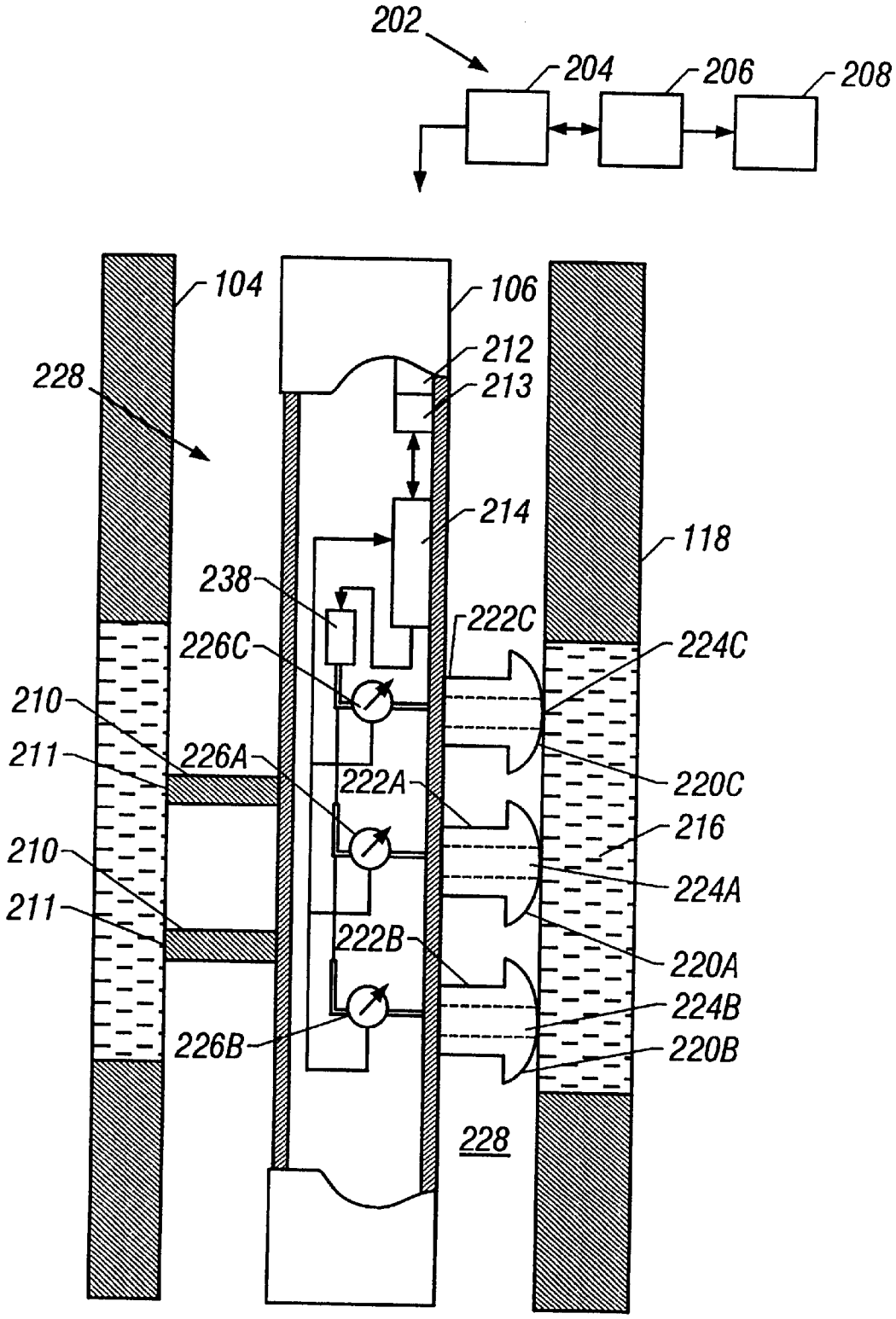
FIG. 2 is a schematic representation of an apparatus according to the present invention.

FIG. 2 is a schematic representation of an apparatus according to the present invention. The system includes surface components and downhole components to carry out formation testing while drilling (FTWD) operations. A borehole 104 is shown drilled into a formation 118 containing a formation fluid 216. Disposed in the borehole 104 is a drill string 106. The downhole components are conveyed on the drill string 106, and the surface components are located in suitable locations on the surface. A typical surface controller 202 includes a communication system 204, a processor 206 and an input/output device 208. The input/output device 208 may be any known user interface device such as a personal computer, computer terminal, touch screen, keyboard or stylus. A display such as a monitor may be included for real time monitoring by the user. A printer may be used when hard-copy reports are desired, and with a storage media such as CD, tape or disk, data retrieved from downhole may be stored for delivery to a client or for future analyses. The processor 206 is used for processing commands to be transmitted downhole and for processing data received from downhole via the communication system 204. The surface communication system 204 includes a receiver for receiving data transmitted from downhole and transferring the data to the surface processor for evaluation and display. A transmitter is also included with the communication system 204 to send commands to the downhole components. Telemetry is typically mud pulse telemetry well known in the art. However, any telemetry system suitable for a particular application may be used. For example, wireline applications would preferably use cable telemetry.

A downhole two-way communication unit 212 and power supply 213 known in the art are disposed in the drill string 106. The two-way communication unit 212 includes a transmitter and receiver for two-way communication with the surface controller 202. The power supply 213, typically a mud turbine generator, provides electrical power to run the downhole components. The power supply may also be a battery or any other suitable device.

A controller 214 is shown mounted on the drill string 106 below the two-way communication unit 212 and power supply 213. A downhole processor (not separately shown) is preferred when using mud-pulse telemetry or whenever processing commands and data downhole is desired. The processor is typically integral to the controller 214 but may also be located in other suitable locations. The controller 214 uses preprogrammed methods, surface-initiated commands or a combination to control the downhole components. The controller controls extendable anchoring, stabilizing and sealing elements such as selectively extendable grippers 210 and pad members 220A–C.

The grippers 210 are shown mounted on the drill string 106 generally opposite the pad members 220A–C. The grippers may also be located in other orientations relative to the pad members. Each gripper 210 has a roughened end surface 211 for engaging the borehole wall to anchor the drill string 106. Anchoring the drill string serves to protect soft components such as an elastomeric or other suitable sealing material disposed on the end of the pad members 220A–C from damage due to movement of the drill string. The grippers 210 would be especially desirable in offshore systems such as the one shown in FIG. 1, because movement caused by heave can cause premature wear out of sealing components.

Mounted on the drill string 106 generally opposite the grippers 210 are at least two and preferably at least three pad members 220A–C for engaging the borehole wall. A pad piston 222A–C is used to extend each pad 220A–C to the borehole wall, and each pad 220A–C seals a portion of the annulus 228 from the rest of the annulus. Not-shown conduits may be used to direct pressurized fluid to extend pistons 222A–C hydraulically, or the pistons 222A–C may be extended using a motor. A port 224A–C located on each pad 220A–C has a substantially circular cross-section with a port radius $R_P$. Fluid 216 tends to enter a sealed annulus when the pressure at a corresponding port 224A–C drops below the pressure of the surrounding formation 118. A drawdown pump 238 mounted in the drill string 106 is connected to one or more of the ports 224A–C. The pump 238 must be capable of controlling independently a drawdown pressure in each port to which the pump is connected.

The pump 238 may be a single pump capable of controlling drawdown pressure at a selected port. The pump 238 may in the alternative be a plurality of pumps with each pump controlling pressure at a selected corresponding port. The preferred pump is a typical positive displacement pump such as a piston pump. The pump 238 includes a power source such as a mud turbine or electric motor used to operate the pump. A controller 214 is mounted in the drill string and is connected to the pump 238. The controller controls operations of the pump 238 including selecting a port for drawdown and controlling drawdown parameters.

For testing operations, the controller 214 activates the pump 238 to reduce the pressure in at least one of the ports 224A–C, which for the purposes of this application will be termed the control port 224A. The reduced pressure causes a pressure disturbance in the formation that will be described in greater detail hereinafter. A pressure sensor 226A is in fluid communication with the control port 224A measures the pressure at the control port 224A. Pressure sensors 226B and 226C in fluid communication with the other ports 224B and 224C (hereinafter sensing ports) are used to measure the pressure at each of the sensing ports 224B and 224C. The sensing ports 224B and 224C are axially, vertically or spirally spaced apart from the control port 224A, and pressure measurements at the sensing ports 224B and 224C are indicative of the permeability of the formation being tested when compared to the pressure of the control port 224A. For reliable and accurate determination of formation permeability, the ports 224A–C must be spaced relative to the size of each port. This size-spacing relationship will be discussed with reference to FIGS. 3A and 3B.

Figure 3A:
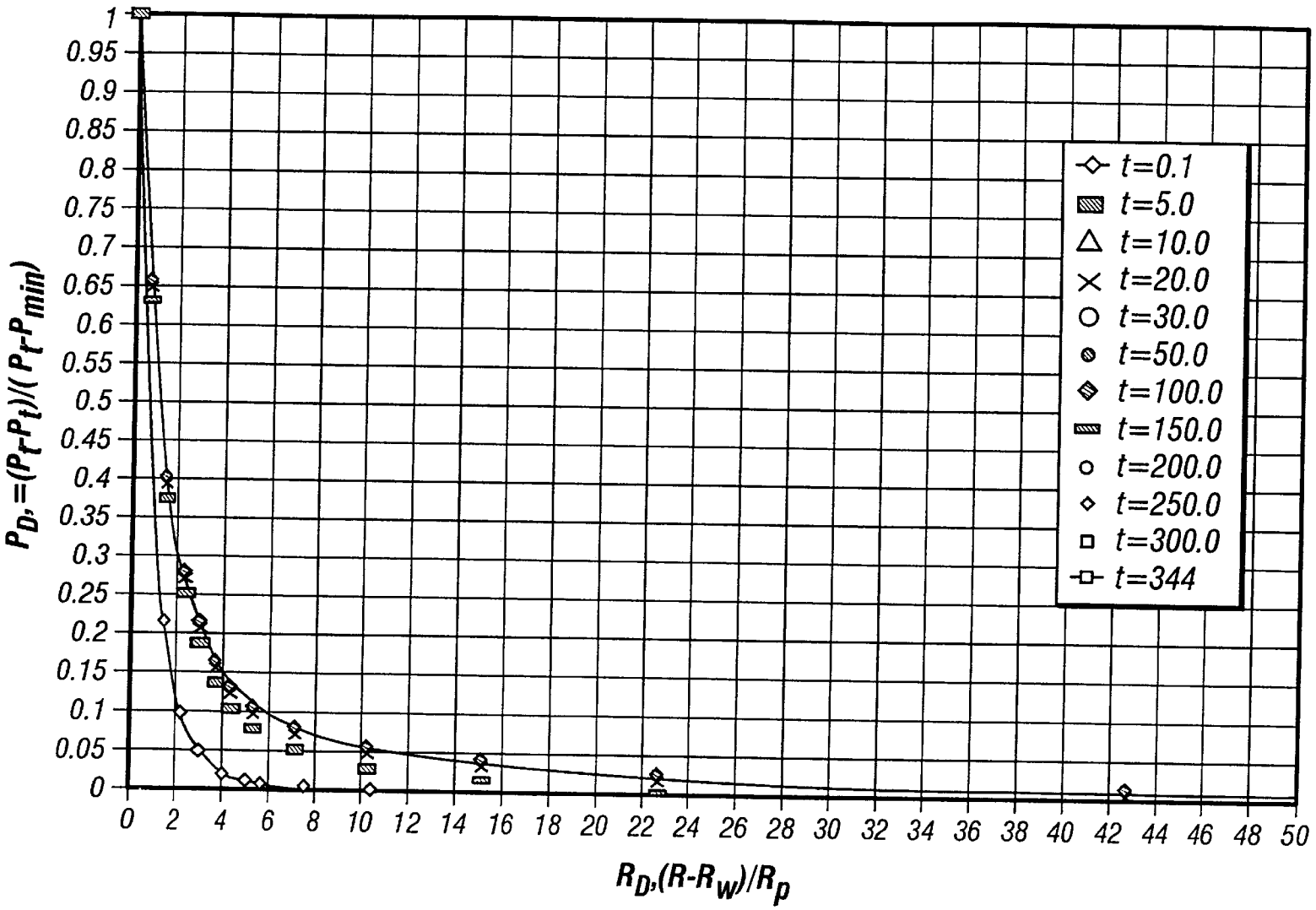
FIG. 3A shows a knowledge-based plot of pressure ratio vs. radius ratio for a drawdown test at given parameters.

FIG. 3A shows a knowledge-based plot of pressure ratio vs. radius ratio for a drawdown test at given parameters. The parameters affecting the plot and their associated units are formation permeability (k) measured in milli-darcys (md), test flow rate (q) measured in cubic centimeters per second (cc/s) and drawdown time ($t_d$) measured in seconds (s). For the plot of FIG. 3A, the values selected are k=1 md, q=2 cc/s and $t_d$=600 s. In the graph, $P_D$ is a dimensionless ratio of pressures associated with a typical drawdown test. Equation 1 can describe this ratio as follows.

$$P_D=(P_f-P)/(P_f-P_{min}) \quad \text{Eq. 1}$$

In Equation 1, $P_f$=Formation Pressure, $P_{min}$=minimum pressure at the port during the drawdown test, and P=pressure at the port at any given time. $R_D$ is a dimensionless ratio of radii associated with a well borehole and test apparatus such as the apparatus in FIG. 2. Equation 2 describes $R_D$.

$$R_D=(R-R_w)/R_p \quad \text{Eq. 2}$$

In Equation 2, R=radius from the center of the borehole to any given point into the formation. $R_w$=the borehole radius, and $R_p$=the effective radius of the tool probe port. Any distance dimension for distance is suitable, and in this case centimeters are used.

An important observation should be made in the plot of FIG. 3A. The plot shows $P_D$ at observation intervals of t=0.1 s through t=344 s. $P_D$ becomes essentially invariant after $R_D$ exceeds 6.5 for t=0.1 s and also when $R_D$ exceeds approximately 12 for t>=5.0 s. This means that changes in the formation pressure based on a disturbance such as a drawdown test at a port location are almost nonexistent in the formation beyond about 12×the radius of the port ($R_p$) creating the disturbance.

Figure 3B:
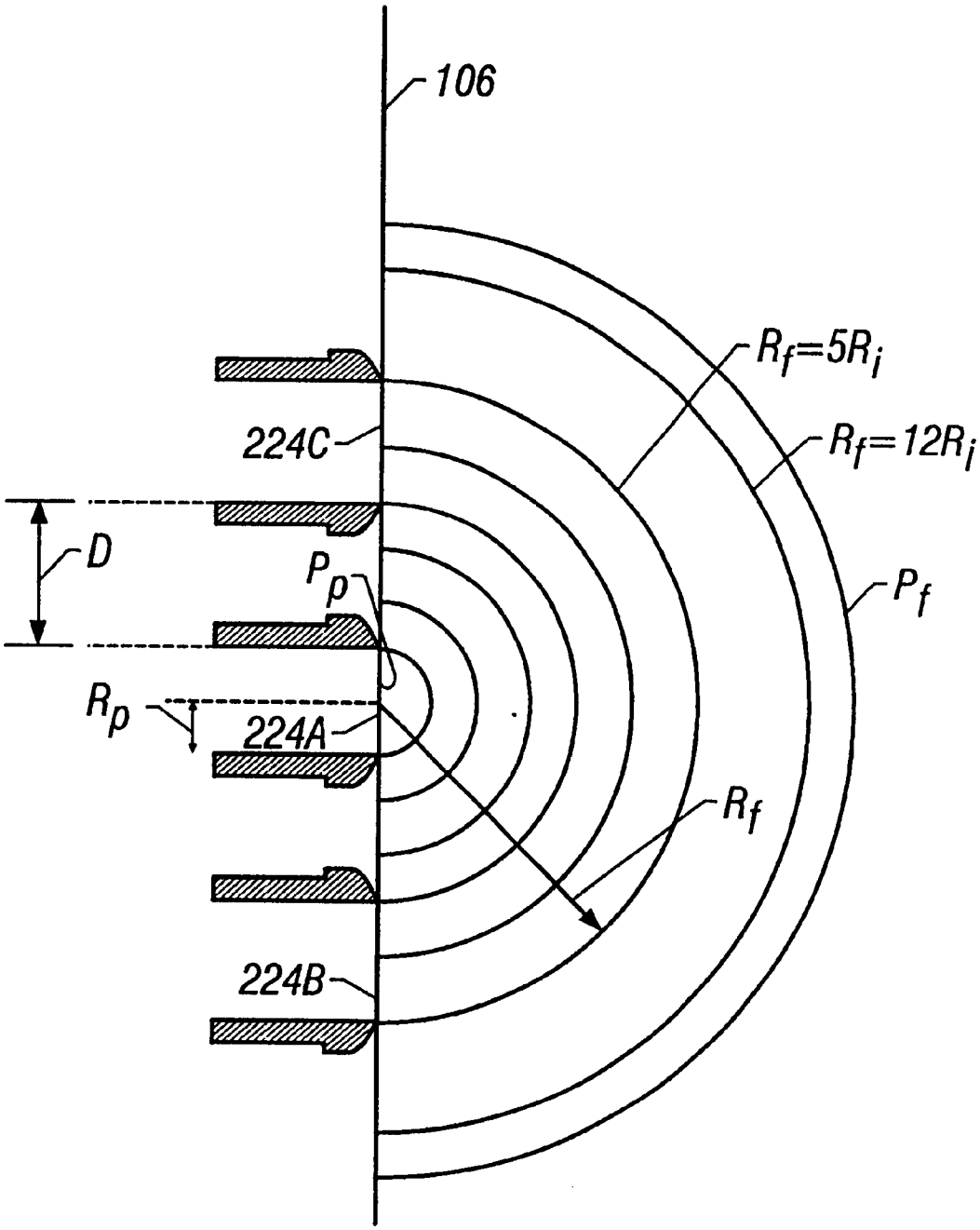
FIG. 3B shows the effect of a disturbance to formation pressure such as the test of FIG. 3A.

FIG. 3B shows the effect of a disturbance to formation pressure such as the test of FIG. 3A. FIG. 3B shows a control port 224A at a given time where the port pressure has been reduced thereby disturbing the formation pressure $P_f$. Each semicircular pressure gradient line is a cross section of the actual effect, which is a hemispherical propagation of disturbance originating at the center of the control port 224A. Each line represents the ratio of pressure related to the initial formation pressure $P_f$ to the pressure disturbance at a distance $R_f$ from the control port 224A. The distance of each line is a multiple of the port radius $R_p$ into the formation. At $R_f=5\times R_p$, the pressure ratio $P_D$=0.85. Meaning the pressure of the formation is 0.85×the initial pressure $P_f$ at a distance of $R_f=5\times R_p$ away from the center of the control port 224A. At $12\times R_p$ the formation pressure is virtually unaffected by the initial disturbance $P_p$ at the control port 224A.

As stated above, the disturbance pattern is substantially spherical and originating at the center of the control port 224A, thus the distances of $5\times R_p$ and $12\times R_p$ also define locations along a drill string 106 and about the circumference of the drill string 106 housing the control port 224A relative to the control port 224A. Therefore, referring back to FIG. 2, the distance D between the control port 216A and any of the sensing ports 224B and 224C must be selected based on the size of the port and borehole such that $P_D$ is maximized. The preferred distance between ports for the present invention is a range of between 1 and 12 times the radius of the control port 224A.

Permeability of a formation has vertical and horizontal components. Vertical permeability is the permeability of a formation in a direction substantially perpendicular to the surface of the earth, and horizontal permeability is the permeability of a formation in a direction substantially parallel to the surface and perpendicular to the vertical permeability direction. The embodiment shown FIG. 2 is one way of measuring vertical permeability. The embodiments following are different configurations according to the present invention for measuring vertical permeability, horizontal permeability and combined vertical and horizontal permeability.

Figures 4A, 4B, 4C:
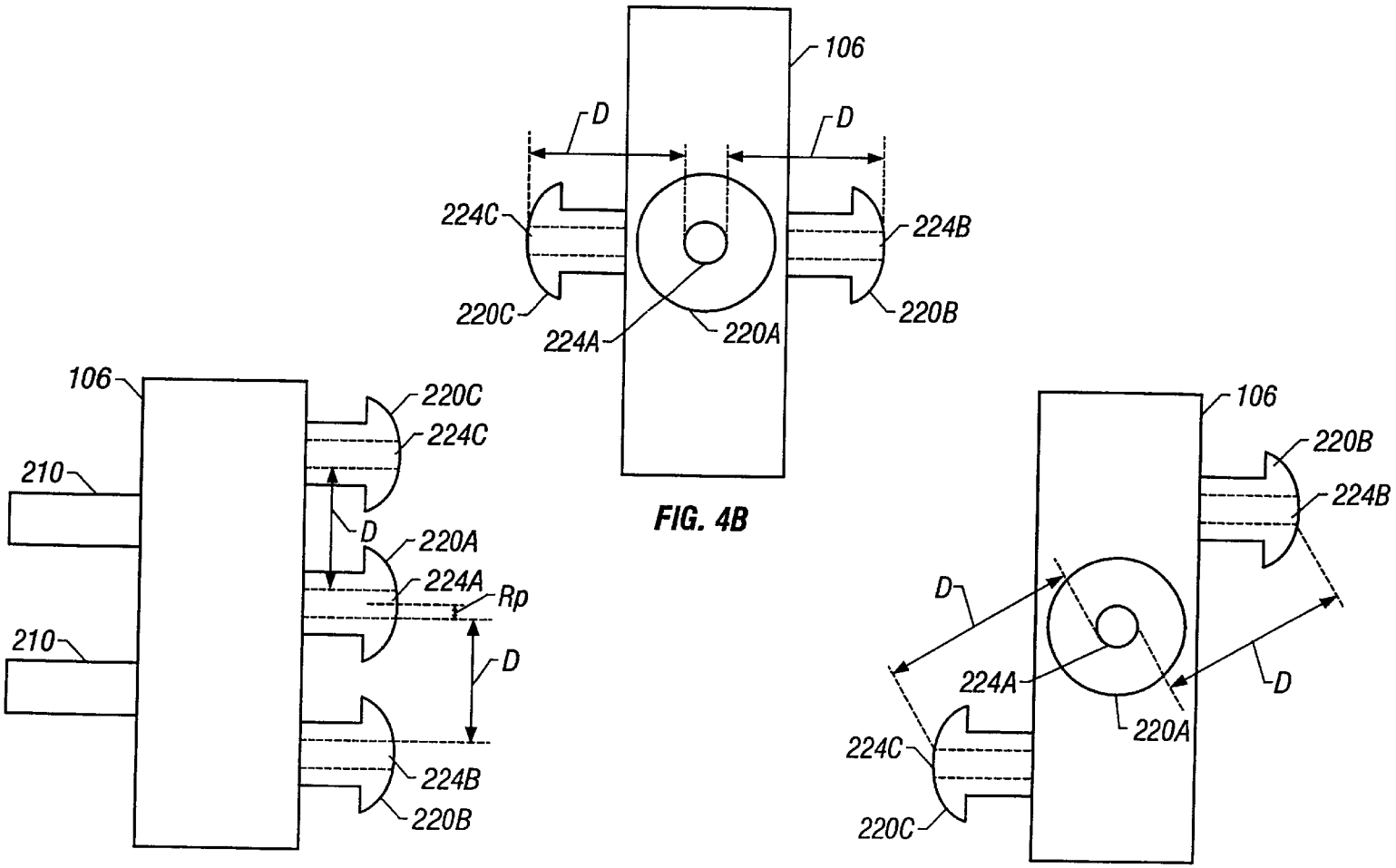
FIGS. 4A–4C show three separate embodiments of the port section of a test string according to the present invention wherein each port of a plurality of ports is mounted on a corresponding selectively extendable pad member.

FIGS. 4A–4C show three separate embodiments of the port section of a test string according to the present invention wherein each port of a plurality of ports is mounted on a corresponding selectively extendable pad member. FIG. 4A shows selectively extendable pad members 220A–C mounted in the configuration shown in FIG. 2. Grippers 210 are mounted generally opposite the pad members to anchor the drill string and provide an opposing force to the extended pad elements 220A–C. The straight-line distance D between the control port 224A and either sensing port 224B or 224C must conform to the distance calculations described above.

FIG. 4B shows a plurality of selectively extendable pad members disposed about the circumference of the drill string 106. The circumferential distance D between each sensing port 224B and 224C and the control port 224A is selected based the criteria defined above. In this configuration horizontal permeability can be measured in a vertically oriented borehole.

FIG. 4C is a set of selectively extendable pad members 220A–C spirally disposed about the circumference of a drill string 106. In this configuration a determination can be made of the composite horizontal permeability and vertical permeability of a formation. The helical distance D between the control port 224A and either sensing port 224B or 224C must be selected as discussed above.

Figure 5B:
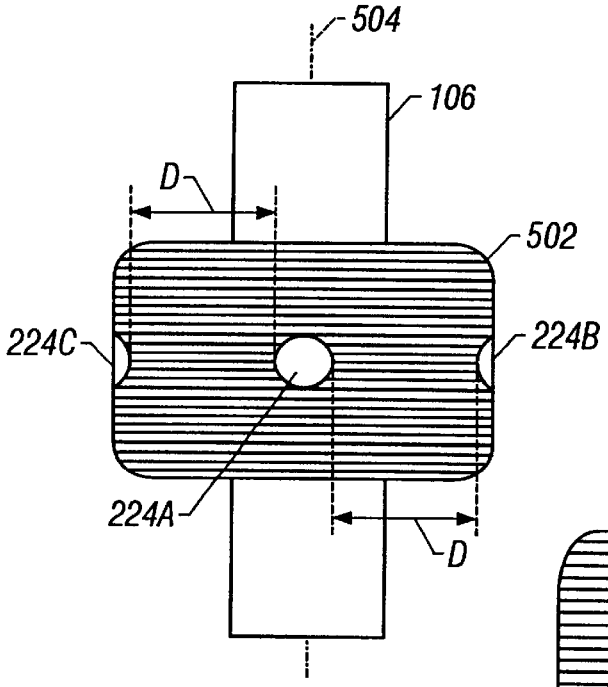
FIGS. 5A–5C show three alternative embodiments of the present invention wherein multiple ports are axially and spirally spaced and integral to an inflatable packer for conducting vertical and horizontal permeability tests.
Figure 5A:
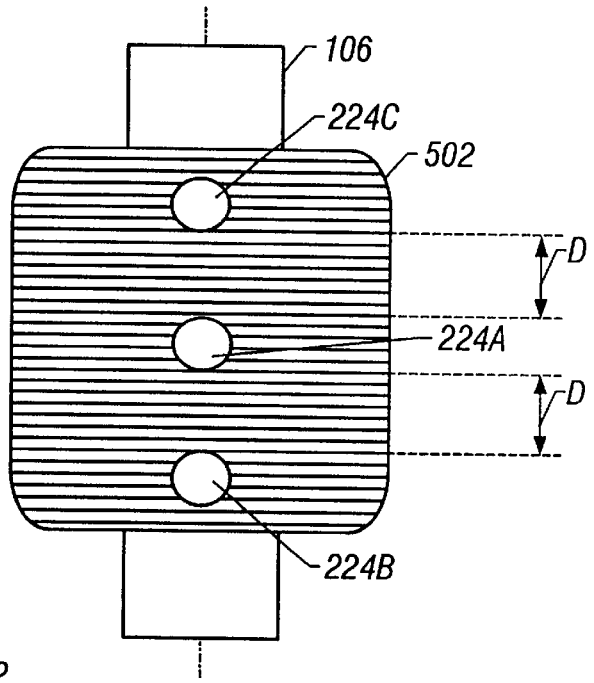
Figure 5C:
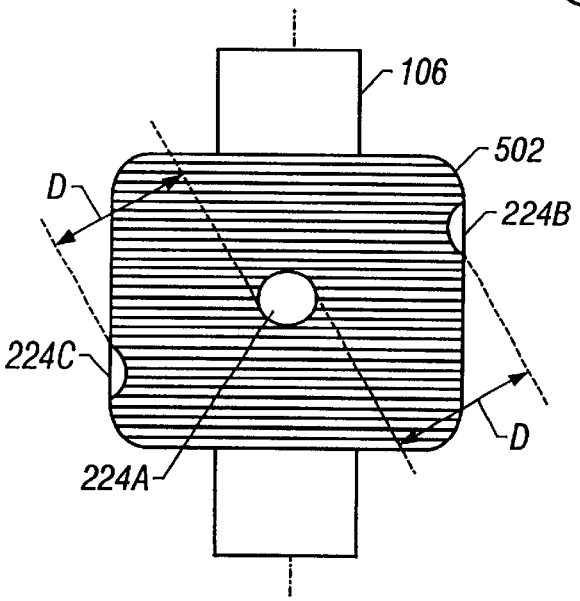

Another well-known component associated with formation testing tools is a packer. A packer is typically an inflatable component disposed on a drill string and used to seal (or shut in) a well borehole. The packer is typically inflated by pumping drilling mud from the drill string into the packer. FIGS. 5A–5C show three alternative embodiments of the present invention wherein multiple ports are axially and spirally spaced and integral to an inflatable packer for conducting vertical and horizontal permeability tests.

FIG. 5A shows a selectively expandable packer 502 disposed on a drill string 106. Integral to the packer 502 are axially spaced ports 224A–224C. When the packer is inflated, the packer seals against the wall of a borehole. The axially spaced ports are thus urged against the wall. The straight-line distance D between control port 224A and either port 224B or 224C is selected in compliance with the requirements discussed above.

FIG. 5B shows a selectively expandable packer 502 disposed on a drill string 106. Ports 224A–C are disposed about the circumference of the packer 502. For this configuration, a plane intersecting the center of the ports 224A–C should be substantially perpendicular to the drill string axis 504. The circumferential distance D between the control port 224A and either sensing ports 224B or 224C is selected based the criteria defined above. In this configuration horizontal permeability can be measured in a vertically oriented borehole.

FIG. 5C shows a selectively expandable packer 502 disposed on a drill string 106. Ports 224A–C are integral to and spirally disposed about the circumference of the expandable packer 502. In this configuration a determination can be made of the composite horizontal permeability and vertical permeability of a formation. For a spiral configuration, ports 224A–C are displaced horizontally and axially from each other about the circumference of the packer 502. The helical distance D between the control port 224A and either sensing port 224B or 224C is as described above.

Figure 6:
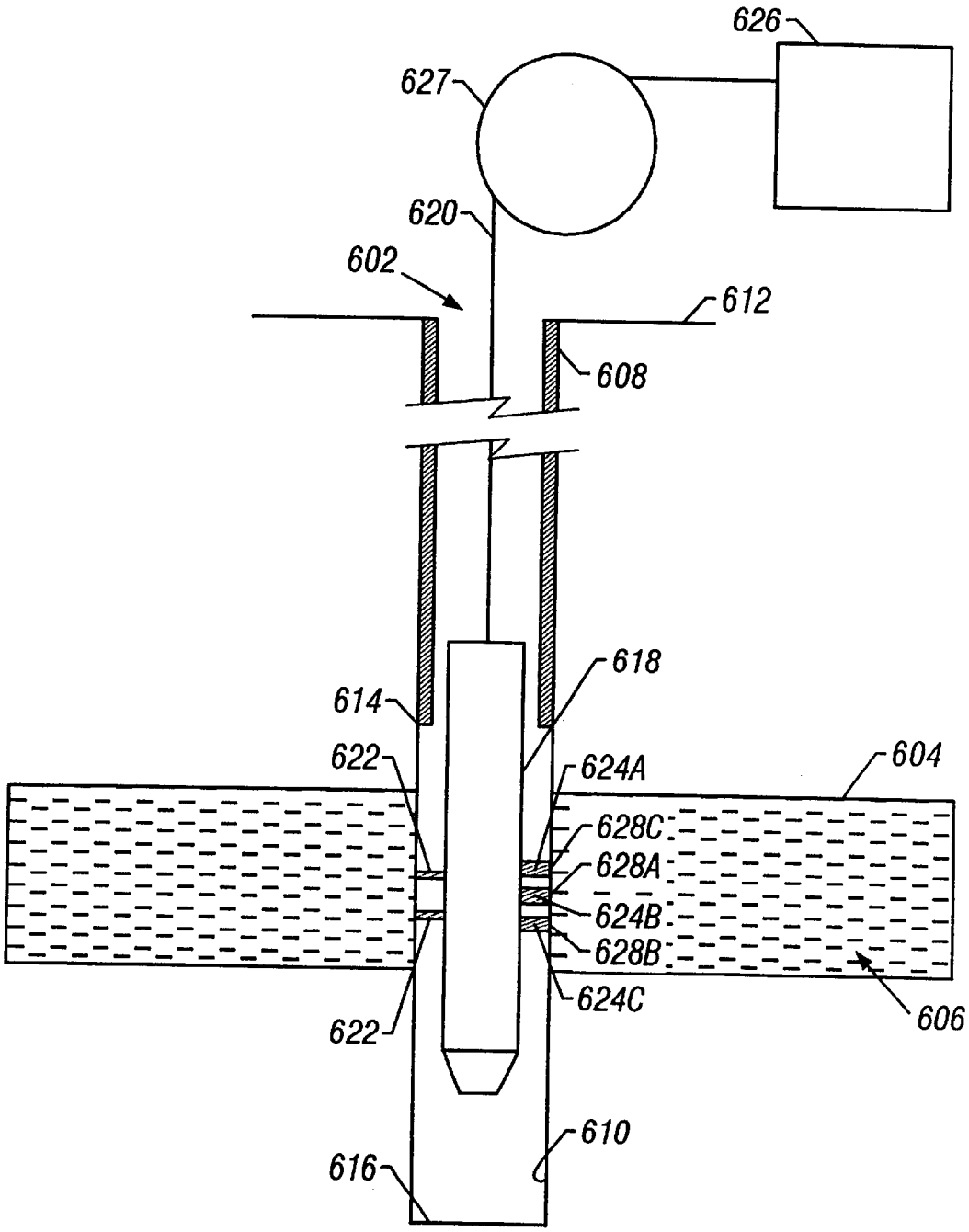
FIG. 6 shows another embodiment of a tool according to the present invention wherein the tool is conveyed on a wireline.

FIG. 6 shows another embodiment of a tool according to the present invention wherein the tool is conveyed on a wireline. A well 602 is shown traversing a formation 604 containing formation fluid 606. The well 602 has a casing 608 disposed on a borehole wall 610 from the surface 612 to a point 614 above the well bottom 616. A wireline tool 618 supported by an armored cable 620 is disposed in the well 602 adjacent the fluid-bearing formation 604. Extending from the tool 618 are grippers 622 and pad members 624A–C. The grippers and pad members are as described in the embodiment shown in FIG. 2. Each pad member 624 has a port 628A–C, and the ports 628A–C are vertically spaced in accordance with the spacing requirements described with respect to FIGS. 3A and 3B. A surface control unit 626 controls the downhole tool 618 via the armored cable 620, which is also a conductor for conducting power to and signals to and from the tool 618. A cable sheave 627 is used to guide the armored cable 620 into the well 602.

The downhole tool 618 includes a pump, a plurality of sensors, control unit, and two-way communication system as described above for the embodiment shown in FIG. 2. Therefore these components are not shown separately in FIG. 6.

Figure 7:
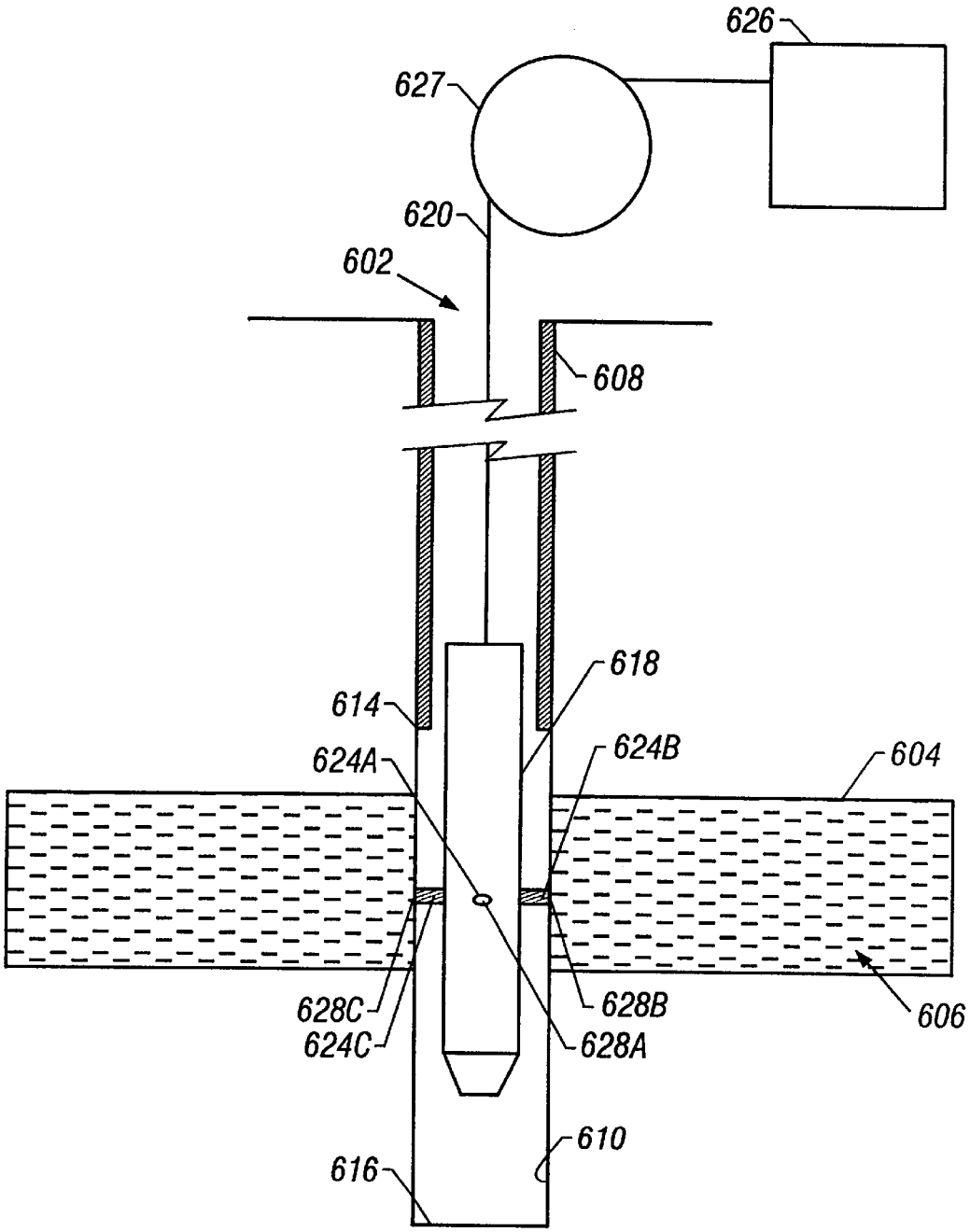
FIG. 7 is an alternative wireline embodiment of the present invention wherein the multiple pad members are arranged such that the ports 216 disposed on the pad members are spaced substantially coplanar to one another around the circumference of the tool to allow for determining horizontal permeability of the formation.

FIG. 7 is an alternative wireline embodiment of the present invention. In this embodiment, with the exception of the grippers 622 (FIG. 6) all components of a wireline apparatus as described above with respect to FIG. 6 are present in the embodiment of FIG. 7. The difference between the embodiment of FIG. 7 and the embodiment of FIG. 6 is that the multiple pad members in FIG. 7 are arranged such that the ports 628A–C disposed on the pad members 624A–C are spaced substantially coplanar to one another around the circumference of the tool 618 to allow for determining horizontal permeability of the formation 604.

Figure 8:
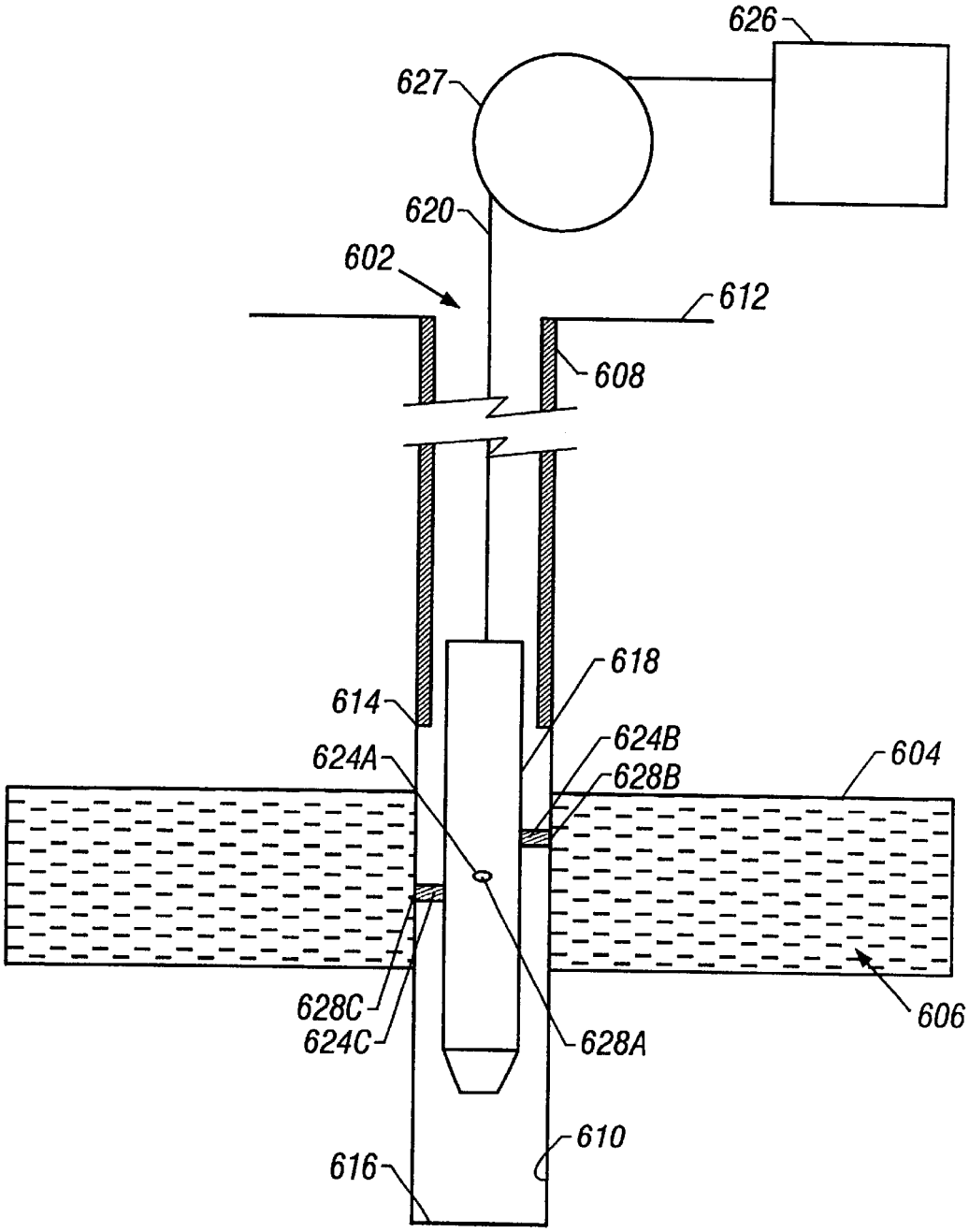
FIG. 8 is another wireline embodiment of the present invention wherein the multiple pad members are arranged spaced spirally around the circumference of the tool to allow for determining the composite of horizontal permeability and vertical permeability of the formation.

FIG. 8 is another wireline embodiment of the present invention. In this embodiment, all components of a wireline apparatus as described above with respect to FIG. 6 are present. The difference between the embodiment of FIG. 8 and the embodiment of FIG. 6 is that the multiple pad members 624A–C in FIG. 8 are arranged spaced spirally around the circumference of the tool 618 to allow for determining the composite of horizontal permeability and vertical permeability of the formation 604.

Figure 9:
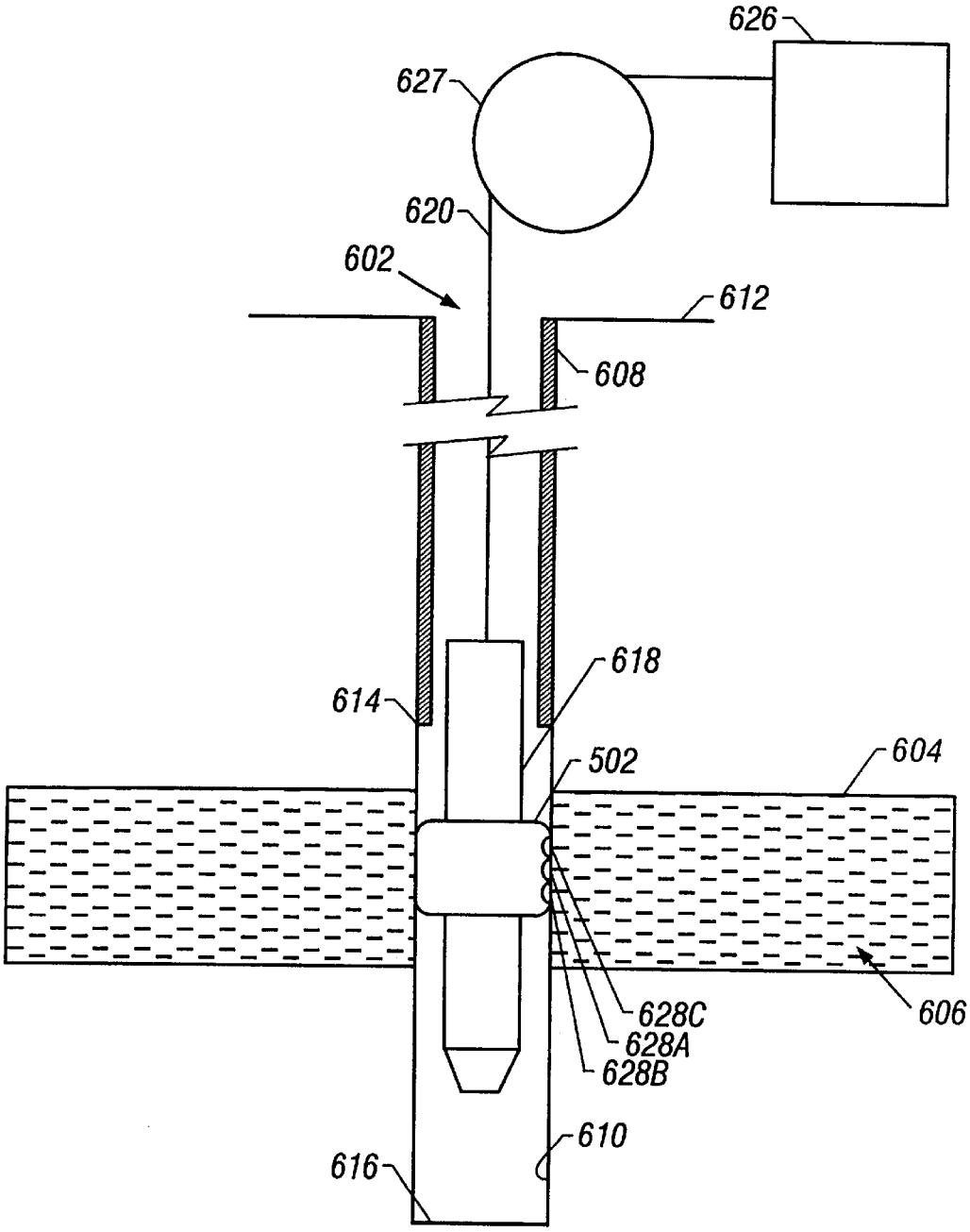
FIG. 9 is another embodiment of the present invention wherein test ports 216 are integrated into a packer in an axial arrangement.

FIG. 9 is yet another alternate wireline embodiment of the present invention wherein test ports 628A–C are integrated into a packer 502 in an axial arrangement as described above with respect to FIG. 5A. In this embodiment, a wireline apparatus is as described with respect to FIG. 6 with the exception of the pad members 624A–C and grippers 622. Instead of extendable pad members 624A–C, an inflatable packer 502 such as the packer described with respect to FIGS. 5A–C includes at least two and preferably at least three test ports 628A–C. One test port is the control port 628A and the other ports are the sensor ports 628B and 628C for sensing the effect on the formation pressure at the test port locations caused by reducing the pressure at the control port 628A. The ports in FIG. 9 are shown spaced axially, as in FIG. 5A, for determining vertical permeability of the formation 604 when the well 602 is essentially vertical.

Figure 10:
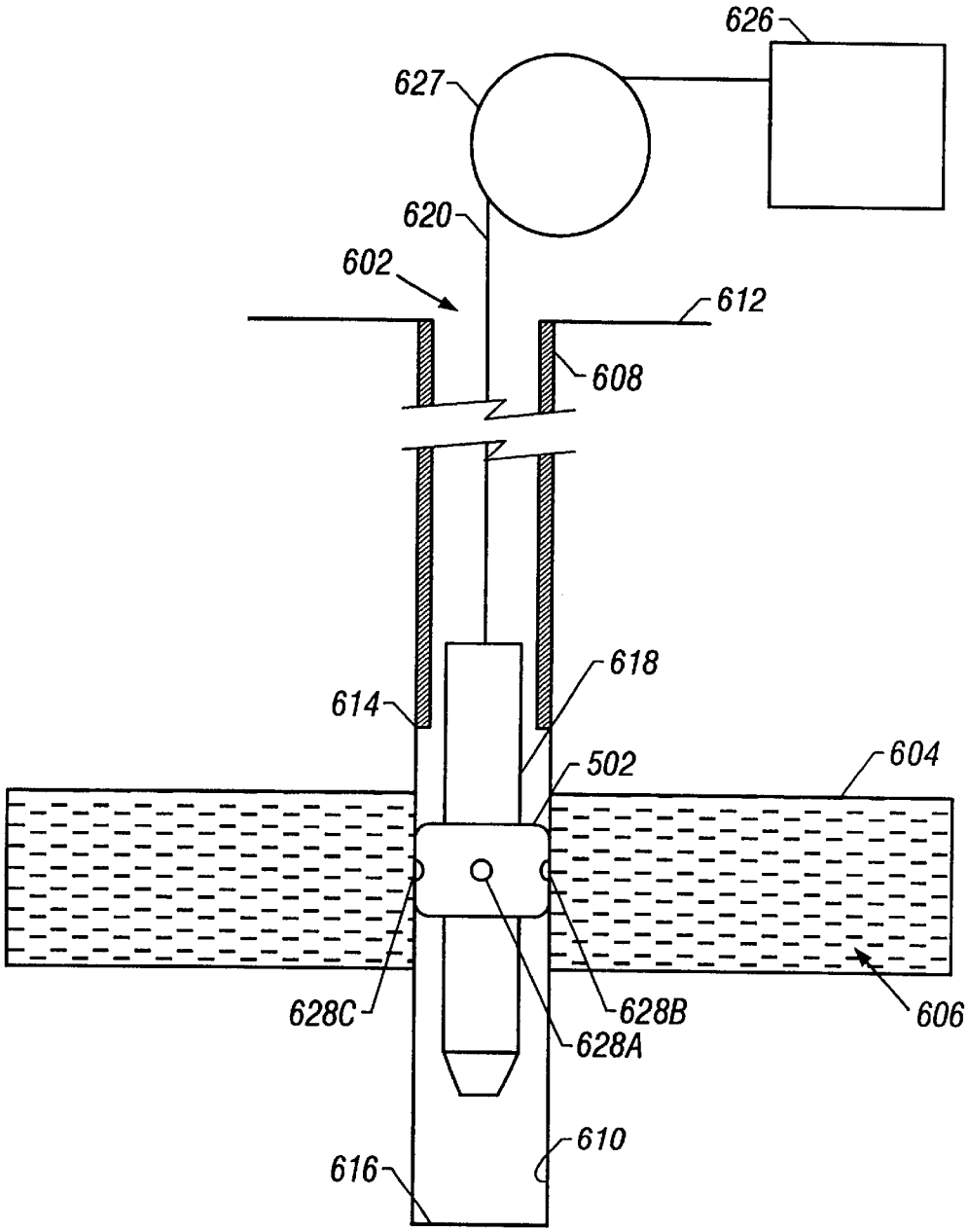
FIG. 10 is another embodiment of the present invention wherein the multiple ports are arranged spaced substantially coplanar to one another around the circumference of the tool to allow for determining horizontal permeability of the formation.

FIG. 10 is an alternative wireline embodiment of the present invention. In this embodiment, all components of a wireline apparatus as described above with respect to FIG. 9 are present. The difference between the embodiment of FIG. 10 and the embodiment of FIG. 9 is that the multiple ports 628A–C in FIG. 10 are arranged spaced substantially coplanar to one another around the circumference of the tool 618 as in FIG. 5B to allow for determining horizontal permeability of the formation 604.

The tool of FIG. 10 may be used while drilling a horizonital borehole. In this case, an orientation sensing device such as an accelerometer may be used to determine the orientation of each of the ports 628A–C. The controller (See FIG. 2 at 214) may then be used to select a port on the top side of the tool for making the measurements as described above.

Figure 11:
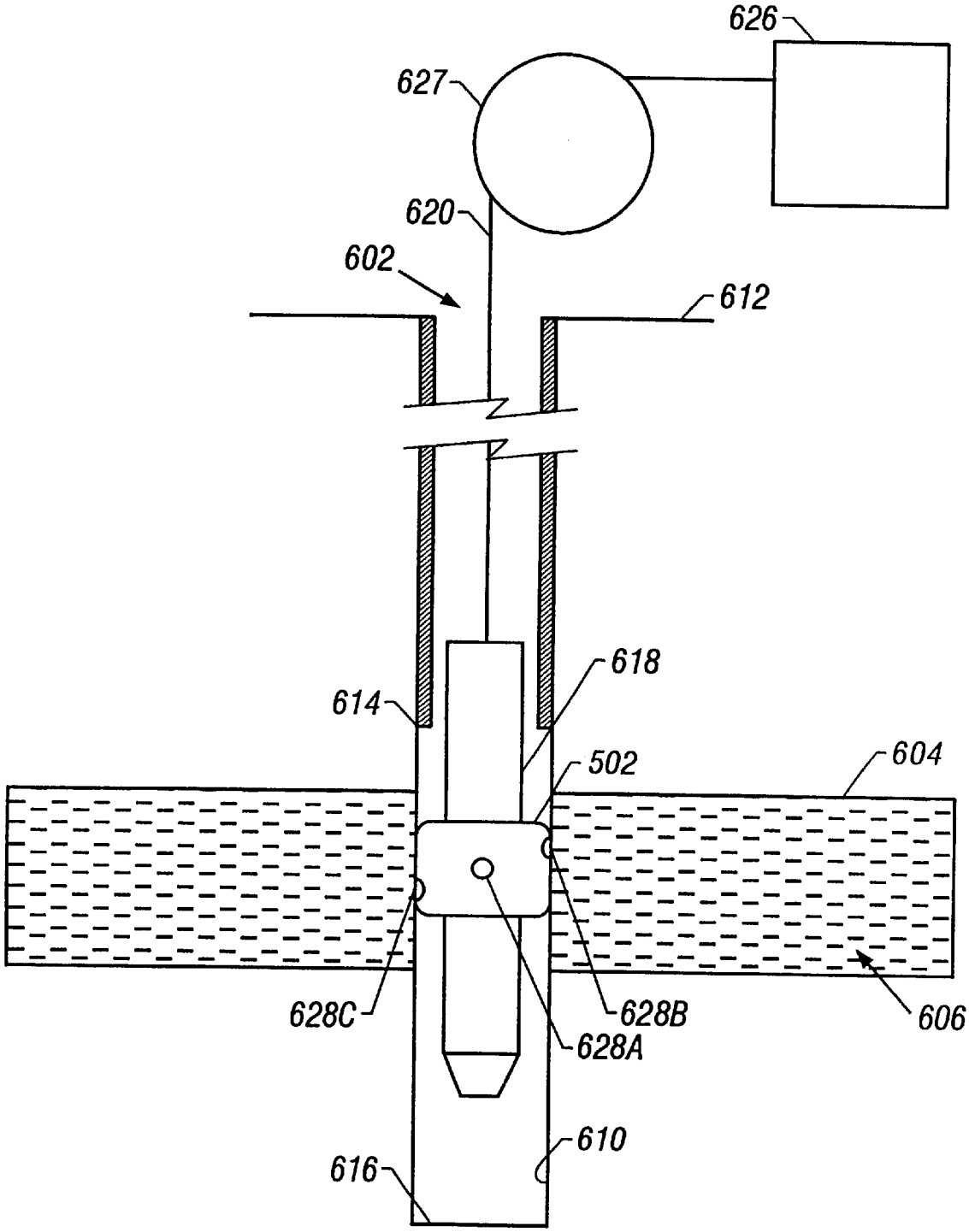
FIG. 11 is an alternative wireline embodiment of the present invention wherein the multiple ports are arranged spaced spirally around the circumference of the tool to allow for determining the composite of horizontal permeability and vertical permeability of the formation.

FIG. 11 is an alternative wireline embodiment of the present invention. In this embodiment, all components of a wireline apparatus as described above with respect to FIG. 9 are present. The difference between the embodiment of FIG. 11 and the embodiment of FIG. 9 is that the multiple ports 628A–C in FIG. 11 are arranged spaced spirally around the circumference of the tool 618 as in FIG. 5C to allow for determining the composite of horizontal permeability and vertical permeability of the formation 604.

Other embodiments and minor variations are considered within the scope of this invention. For example, the ports 216A–216C may be shaped other than with a substantially circular cross-section area. The ports may be elongated, square, or any other suitable shape. Whatever shape is used, $R_p$ must be the distance from the center of the port to an edge nearest the center of the control port. The control port edge and an adjacent sensor port must be spaced as discussed above with respect to FIGS. 3A and 3B.

Now that system embodiments of the invention have been described, a method of testing formation permeability using the apparatus of FIGS. 1 and 2 will be described. Referring first to FIGS. 1 and 2, a tool according to the present invention is conveyed into a well 104 on a drill string 106, the well 104 traversing a formation 118 containing formation fluid. The drill string 106 is anchored to the well wall by extending a plurality of grippers 210. At least two and preferably three pad members 220A–C are extended until each is brought into sealing contact with the borehole wall 244. A control port 224A is exposed to the sealed section such that the control port is in fluid communication with formation fluid in the formation 118. Using a pump 238, fluid pressure at the control port 224A is reduced to disturb formation pressure in the formation 118. The level to which the pressure at the control port 224A is reduced is sensed using a sensor 226A. The pressure disturbance is propagated through the formation, and the effect of the disturbance is attenuated based on the permeability of the formation. The attenuated pressure disturbance is sensed at the sensor ports by sensors 226B and 226C disposed in fluid communication with the sensor ports 224B and 224C. At least one parameter of interest such as formation pressure, temperature, fluid dielectric constant or resistivity is sensed with the sensors 224A–C, and a downhole controller/processor 214 is used to determine formation pressure and permeability or any other desired parameter of the fluid or formation.

Processed data is then transmitted to the surface using a two-way communications unit 212 disposed downhole on the drill string 106. Using a surface communications unit 204, the processed data is received and forwarded to a surface processor 206. The method further comprises processing the data at the surface for output to a display unit, printer, or storage device 208.

Alternative methods are not limited to the method described above. The tool may be conveyed on a wireline. Also, whether conveyed on a wireline or drill string, the ports 224A–C may be configured axially, horizontally or spirally with respect to a center axis of the tool. The ports 224A–C may also be extended using extendable pad members as discussed or by using an expandable packer.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for determining a parameter of interest of a subterranean formation in-situ, comprising:

(a) a work string for conveying a tool into a well borehole, the borehole and tool having an annular space extending between the tool and a wall of the borehole;

(b) at least one selectively extendable member mounted on the tool, the at least one extendable member being capable of isolating a portion of the annular space;

(c) at least two ports in the tool, the ports being exposable to a fluid containing formation fluid in the isolated annular space, the at least two ports being isolated from each other and wherein a predetermined distance between the at least two ports is proportional to the size of at least one of the at least two ports and is a range selected from a group consisting of (i) equal to or greater than $1\times R_P$; (ii) less than or equal to $12\times R_P$; and (iii) equal to or greater than $1\times R_P$ and less than or equal to $12\times R_P$; and (d) a measuring device determining at least one characteristic of the fluid in the isolated section, the characteristic being indicative of the parameter of interest.

2. An apparatus according to claim 1 wherein the work string is selected from a group consisting of (i) a jointed pipe; (ii) a coiled tube; and (iii) a wireline.

3. An apparatus according to claim 1 wherein the parameter of interest is selected from a group consisting of (i) vertical permeability; (ii) horizontal permeability; and (iii) a composite of vertical permeability and horizontal permeability.

4. An apparatus according to claim 1 wherein the at least one selectively extendable member is at least two selectively extendable members.

5. An apparatus according to claim 1 wherein each of the at least two selectively extendable members is operatively associated with a corresponding one of the at least two ports.

6. An apparatus according to claim 1 wherein the at least two ports are disposed in the work string in an arrangement selected from a group consisting of (i) an axial arrangement; (ii) a horizontal arrangement; and (iii) a spiral arrangement.

7. An apparatus according to claim 1 wherein the measuring device includes at least one pressure sensor.

8. An apparatus according to claim 7 wherein the at least one pressure sensor is at least two pressure sensors.

9. An apparatus according to claim 8 wherein each of the at least two ports is in fluid communication with a corresponding one of the at least two pressure sensors.

10. An apparatus according to claim 1 wherein the measurement device comprises:

(i) at least one pressure sensor;

(ii) a processor for processing an output of the at least one pressure sensor; and (iii) a downhole two-way communication unit for transmitting a first signal indicative of the parameter of interest to a surface location.

11. An apparatus according to claim 10 further comprising:

(A) a surface two-way communication unit for transmitting a second signal to the downhole two-way communication unit and for receiving the first signal;

(B) a surface processor connected to the surface two-way communication system, the processor for processing the first signal and for the second signal to the surface two-way communication unit; and (C) a surface input/output device connected to the surface processor for user interface.

12. A method for determining a parameter of interest of a subterranean formation in situ, comprising:

(a) conveying a tool on a work string into a well borehole, the tool and borehole having an annular space extending between the tool and a wall of the borehole;

(b) extending at least one selectively extendable member for isolating a portion of the annular space between the tool and the borehole wall;

(c) exposing at least two ports to a fluid in the isolated annulus, the at least two ports being separated from each other and wherein a predetermined distance between the at least two ports is proportional to the size of the control port and is a range selected from a group consisting of (i) equal to or greater than $1\times R_P$; (ii) less than or equal to $12\times R_P$; and (iii) equal to or greater than $1\times R_P$ and less than or equal to $12\times R_P$; and (d) using a measuring device to determine at least one characteristic of the fluid in the isolated section indicative of the parameter of interest.

13. A method according to claim 12 wherein conveying a tool on a work string uses a work string selected from a group consisting of (i) a drill pipe; (ii) a coiled tube; and (iii) a wireline.

14. A method according to claim 12 wherein determining a parameter of interest is determining permeability of the formation.

15. A method according to claim 14 wherein determining permeability is determining permeability selected from a group consisting of (i) vertical permeability; (ii) horizontal permeability; and (iii) a composite of horizontal permeability and vertical permeability.

16. A method for determining permeability of a subterranean formation in situ, comprising:

(a) conveying a tool on a work string into a well borehole, the tool and borehole having an annular space extending between the tool and a wall of the borehole;

(b) extending at least one selectively extendable member for isolating a portion of the annular space between the tool and the borehole wall;

(c) exposing a control port to a fluid in the isolated annulus;

(d) exposing at least one sensor port to a fluid in the isolated annulus, the at least one sensor port and the control port being separated from each other and wherein a predetermined distance between the at least two ports is proportional to the size of the control port and is a range selected from a group consisting of (i) equal to or greater than $1\times R_P$; (ii) less than or equal to $12\times R_P$; and (iii) equal to or greater than $1\times R_P$ and less than or equal to $12\times R_P$;

(e) reducing pressure at the control port to disturb formation pressure at a first interface between the control port and the formation;

(f) sensing the pressure at the control port with a first pressure sensor;

(g) sensing pressure at a second interface between the at least one sensor port and the formation; and (h) using a downhole processor to determine formation permeability from the sensor port pressure and the control port pressure.

17. A method according to claim 16 further comprising transmitting a signal indicative of the permeability to a surface location.

* * * * *